US006119884A

United States Patent [19]

Lowry

[11] Patent Number: 6,119,884

[45] Date of Patent: Sep. 19, 2000

[54] CONTAINER FOR STORING AND DISPENSING FOOD PRODUCTS

[75] Inventor: James W. Lowry, Florence, S.C.

[73] Assignee: Sonoco Development, Inc., Hartsville, S.C.

[21] Appl. No.: 09/109,367

[22] Filed: Jul. 2, 1998

[51] Int. Cl.[7] ..... B65D 25/16

[52] U.S. Cl. ..... 220/62.13; 220/495.03

[58] Field of Search ..... 220/495.03, 62.13, 220/62.21, 495.01, 495.06; 206/804, 255; 222/386, 327

[56] References Cited

U.S. PATENT DOCUMENTS

| | | | |
|---|---|---|---|
| 567,488 | 9/1896 | Moehn | 206/535 |
| 866,243 | 9/1907 | Waechter | 206/804 |
| 1,148,947 | 8/1915 | Boylan . | |
| 1,483,196 | 2/1924 | Prince | 206/804 |
| 1,547,903 | 7/1925 | Cole | 206/223 |
| 1,671,285 | 5/1928 | Hanna | 206/535 |
| 2,125,385 | 8/1938 | MacLean | 206/56 |
| 2,166,619 | 7/1939 | Becker | 220/56 |
| 2,364,916 | 12/1944 | Rasmussen | 206/56 |
| 2,455,633 | 12/1948 | Wilson et al. | 206/41.1 |
| 2,474,315 | 6/1949 | Lavietes . | |
| 2,649,995 | 8/1953 | Muskin . | |
| 2,788,891 | 4/1957 | Taylor | 206/42 |
| 3,144,189 | 8/1964 | Bartz | 229/23 |
| 3,185,339 | 5/1965 | Fleming | 220/495.06 |
| 3,392,878 | 7/1968 | Jackson | 221/65 |
| 3,439,827 | 4/1969 | Marland | 215/100 |
| 3,642,170 | 2/1972 | Shelley | 221/226 |
| 3,927,786 | 12/1975 | Aboud | 220/4.01 |
| 4,228,913 | 10/1980 | Mack et al. | 220/90.2 |
| 4,437,589 | 3/1984 | Potter | 222/327 |
| 5,178,298 | 1/1993 | Allina | 221/24 |
| 5,191,996 | 3/1993 | Jenkins | 221/64 |
| 5,197,658 | 3/1993 | Sprunger | 229/93 |
| 5,295,606 | 3/1994 | Karwoski | 220/403 |
| 5,337,915 | 8/1994 | Hall, Jr. | 220/404 |
| 5,349,196 | 9/1994 | Smith et al. | 222/386 |
| 5,356,106 | 10/1994 | Trotta et al. | 248/243 |
| 5,487,491 | 1/1996 | Smith et al. | 222/95 |
| 5,921,167 | 7/1999 | Giesy et al. | 92/172 |

FOREIGN PATENT DOCUMENTS

| | | | |
|---|---|---|---|
| 17515 | of 0000 | Australia . | |
| WO 92/12798 | 8/1992 | European Pat. Off. | 5/16 |
| WO 97/33812 | 8/1997 | European Pat. Off. . | |
| 671581 | of 0000 | Germany . | |
| 91 07 504 | 9/1991 | Germany | 25/42 |
| WO 95 29853 | 11/1995 | WIPO | 35/28 |

*Primary Examiner*—Stephen Castellano
*Attorney, Agent, or Firm*—Seidel, Gonda, Lavorgna & Monaco, PC

[57] ABSTRACT

The present invention provides a container for storing and dispensing food stuffs. The container includes a shell having a sidewall and a bottom wall. Together, the sidewall and the bottom wall define an interior of the container. The bottom wall is detachably connected to the sidewall. The apparatus further includes a liner positioned within the container for holding the food stuffs. Upon the application of an appropriate force, the bottom wall is detached from the sidewall and forced into the interior of the container. As the bottom wall is forced into the interior of the container, the liner collapses and the food stuffs are forced towards an opening in the container opposite to the bottom wall.

18 Claims, 2 Drawing Sheets

CONTAINER FOR STORING AND DISPENSING FOOD PRODUCTS

FIELD OF THE INVENTION

The present invention relates generally to a container for storing and dispensing food products. The present invention relates more particularly to a container that allows for raising food products within the container to an upper region of the container.

BACKGROUND OF THE INVENTION

A variety of containers are known for storing various types of food products including cereals, chips, etc. Typically, these containers are sized to present a shape that does not readily allow one to access the product that resides at the bottom of the container. More specifically, the container may have an opening that one can not easily insert a hand through to reach the bottom. Alternatively, the container may be of a height that even if one were to insert the full length of one's arm into the container the bottom could not be reached.

U.S. Pat. No. 1,483,196 to Prince discloses an ice cream container having a generally cylindrical inner container and a generally cylindrical outer container surrounding the inner container. The outer container has an open bottom that allows one to engage the inner container bottom with a finger to force the inner container up and out of the outer container thereby exposing the product housed in the inner container.

U.S. Pat. No. 2,166,619 to Becker discloses a container having a generally hollow cylindrical shell and a disk positioned within the shell perpendicular to a longitudinal axis thereof. The disk has an outside diameter substantially equal to the inner diameter of the shell. A rod is attached to the disk and extends along the shell's longitudinal axis. In a first position the disk resides at a first end of the shell with the rod extending outside of the shell. Urging the rod and disk towards a second end of the shell forces the product up and out of the shell.

U.S. Pat. No. 2,125,385 to MacLean discloses a packaging system including a cylindrical shell having a disk and rod arrangement for moving along the longitudinal axis of the shell, similar to U.S. Pat. No. 2,166,619. By forcing the disk/rod arrangement to an open end of the shell, product that is stored in the shell is forced up and out.

U.S. Pat. No. 3,439,827 to Marland discloses a container having an open end and a flexible liner for advancing the contents of the container toward the open end. The liner has a length greater than the container and a diameter sufficient to allow the liner to roll over the rim of the open end of the container. A spring disk member is located within the liner and adjacent the liner bottom. The disk member maintains the liner taught. The liner includes pull tabs for pulling the liner up and out of the container in order to raise material held in the liner. As the liner is pulled out of the container, it may be folded over a rim about the open end and down the container exterior wall. As the liner extends down the container wall, portions of the liner may be torn away along prefabricated tear lines.

U.S. Pat. No. 5,191,996 to Jenkins discloses an apparatus for storing and dispensing slices of bread. The apparatus includes a container for holding the loaf of bread. A plastic wrapper for the bread is folded over an upper rim of the container and down the container exterior side wall. A collar member retains the bread wrapper about the exterior wall.

As needed, the collar is slid down the container. This, in turn, pulls the wrapper inside the container upwards and raises the bread.

U.S. Pat. No. 5,337,915 to Hall, Jr. discloses an apparatus for storing food products and selectively raising the food products to a top opening for dispensing. The apparatus includes a container, a flexible bag received in the container and a cover for sealably closing the container. The bag preferably has a shape complementing the container. As the bag is raised up and out of the container it is folded over a container top edge and down over an exterior wall. As the bag is raised, the product held therein is also raised for easy access.

U.S. Pat. No. 866,243 to Waechter discloses a container including a movable bottom. A pair of straps are attached to bottom. The free ends of the straps extend upwards and out of the container so that one can pull the straps to raise the bottom along the container.

SUMMARY OF THE INVENTION

The present invention provides a container for storing and dispensing various food products. The container includes a shell. The shell includes a bottom wall and at least one sidewall. The sidewall extends substantially perpendicularly from the bottom wall. Together, the at least one sidewall and the bottom wall define an interior of the container. The sidewall includes an opening opposite to the bottom wall. The shell opening defines an edge. The bottom wall is detachably connected to the sidewall. Upon detachment from the sidewall, the bottom wall may move into the container interior.

A liner is provided within the shell, forms an inner sidewall, and defines a cavity or pouch for holding the food products within the container. The liner includes an opening at one end that defines an edge. The liner edge is fixedly attached to the shell sidewall edge.

The present invention provides a simple apparatus for easily raising food products from the bottom of a container to the container opening.

DETAILED DESCRIPTION OF THE DRAWINGS

Figure 1:
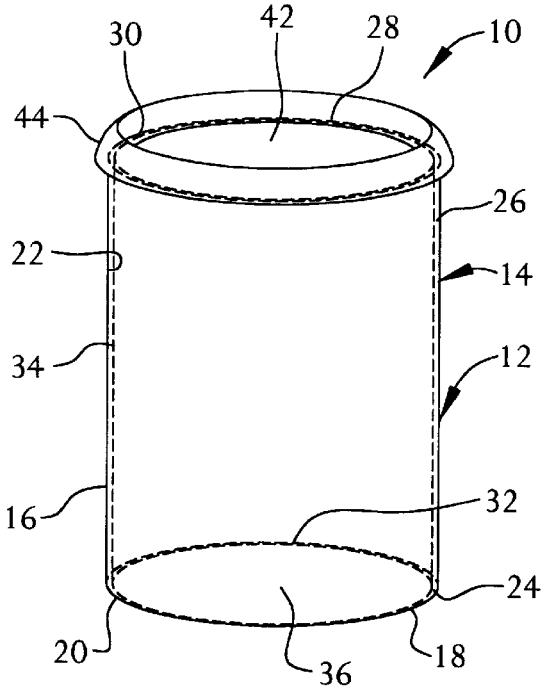
FIG. 1 is a perspective view of a container embodiment of the present invention.
Figure 4:
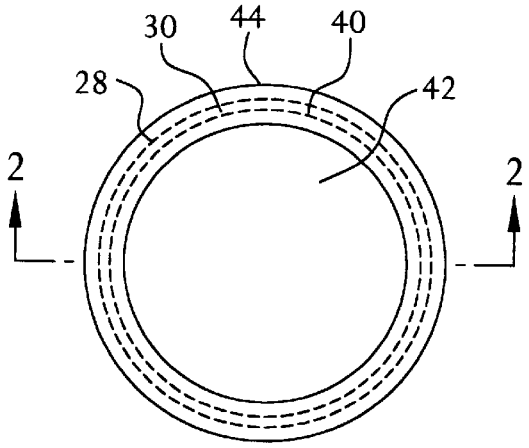
FIG. 4 is a cross sectional view of the container showing the bottom wall in a raised position.

In the drawings, where like numerals identify like elements, there is shown various forms of a container of the present invention. The container is generally designated by the numeral 10.

Figure 2:
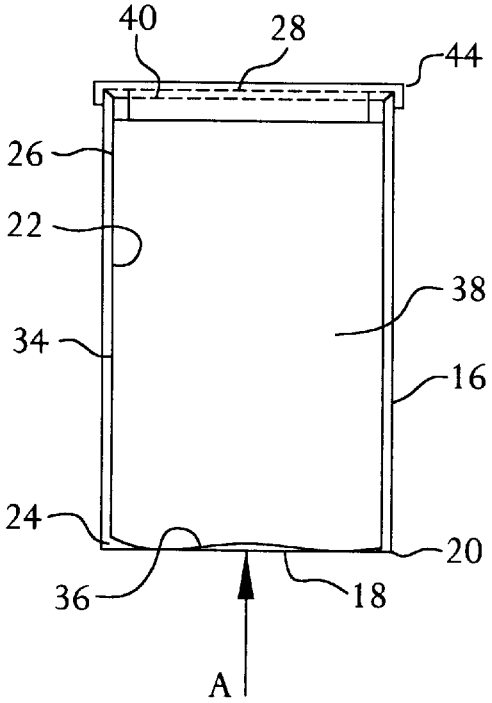
FIG. 2 is a top plan view of the embodiment of FIG. 1.
Figure 3:
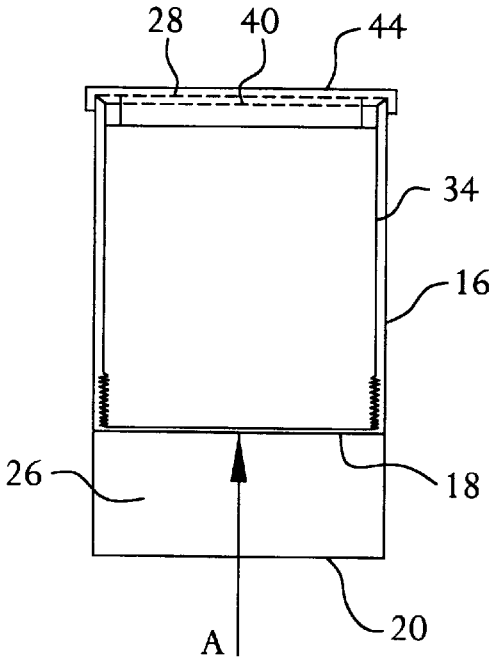
FIG. 3 is a cross sectional view of the container as taken along line 3—3 of FIG. 2.

The container 10 is shown in FIG. 1 as including an outer shell 12 and a collapsible inner liner 14. As illustrated in FIGS. 2 and 3, the outer shell includes a single sidewall 16 in the shape of a cylinder and a bottom wall 18 in the form of a disk. The bottom wall 18 is detachably connected to a first edge 20 of the sidewall 16. The sidewall 16 extends perpendicularly from the bottom wall 18. Together the interior surface 22 of the sidewall 16 and the interior surface 24 of the bottom wall 18 define an interior chamber 26 within the shell 12.

The sidewall 16 includes a second edge 28 opposite to the bottom wall 18. The second edge 28 defines an opening 30 to the interior chamber 26 of the shell 12. The interior surface 22 of the sidewall 16 defines an interior perimeter edge 32. The bottom wall 18 has an exterior circumference measurement substantially equal to the interior circumference measurement of the sidewall 16.

The liner 14 includes a sidewall 34 and a bottom wall 36. Together, the liner sidewall 34 and bottom wall 36 form a pouch or cavity 38 for holding food stuffs. The pouch 38 preferably presents a shape which is substantially equivalent to the shape of the interior chamber 26 of the shell 12. The liner sidewall 34 includes an edge 40 opposite to the bottom wall 36. The liner edge 40 defines an opening 42 to the pouch 38. The liner 14 is positioned within the interior 26 of the shell 12 so that the liner edge 40 is in close proximity to the second edge 28 of the shell sidewall 16. The liner 14 is made of a collapsible material, for example, a paper/foil laminate or a polymer film. In a preferred embodiment, the bottom wall 36 of the liner 14 is attached to the interior surface 24 of the shell bottom wall 18.

The container 10 further includes an end seam 44 for fixedly attaching the liner edge 40 to the second edge 28 of the shell sidewall 16. The end seam 44 may be made of metal or any other suitable material capable of maintaining the liner edge 40 fixed relative to the second edge 28 of the shell sidewall 16.

As illustrated in FIG. 2, the bottom wall 18 is initially connected to the sidewall 16. A series of perforations are formed between the perimeter edge 32 of the bottom wall 18 and the first edge 20 of the sidewall 16. Upon application of an appropriate force in the direction of arrow A, perpendicular to the bottom wall 18 and into the shell interior 26, the perforations will tear and the bottom wall 18 will detach from the sidewall 16. Due to the circumferential measurements of the perimeter edge 32 of the bottom wall 18 and the interior surface 24 of the shell sidewall 16, frictional forces exist between the two. Once the bottom wall 18 has detached from the sidewall 16, these frictional forces will maintain the bottom wall 18 stationary relative to the sidewall 16 after its movement into the interior chamber 26 of the shell 12. A continued application of a force greater than the combined frictional force between the perimeter edge 32 and the interior surface 22 of the sidewall 16 and the weight of any food stuffs remaining in the liner pouch 38 will move the bottom wall 18 along the interior surface 24 of the sidewall 16, further into the container interior 26 and towards the container opening 30. When the force is removed from the bottom wall 18, once again, the frictional forces will keep the bottom wall 18 stationary.

As the bottom wall 18 moves into the interior 26 of the shell 12, the liner 14 collapses. As the liner 14 collapses, the food stuffs stored therein move towards the shell opening 30.

Figure 5:
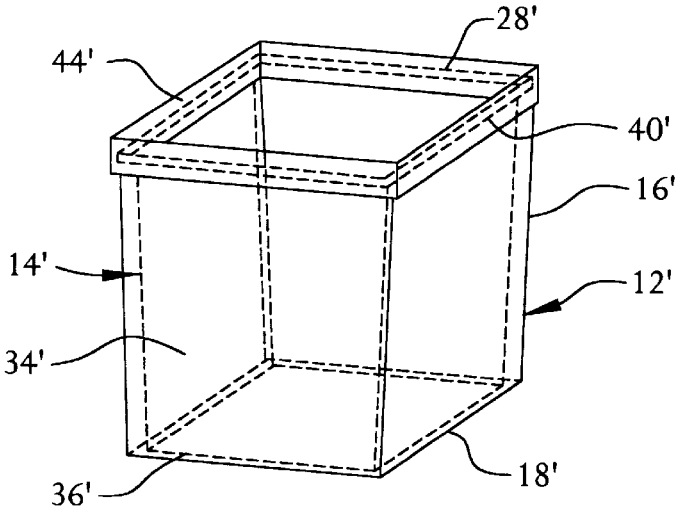
FIG. 5 is a perspective view of another embodiment of a container of the present invention.

In an alternative embodiment, the shell 12 may have a plurality of sidewalls, for example, four sidewalls. As illustrated in FIG. 5, in such an embodiment, the sidewalls 16' extend perpendicular to the bottom wall 18'. The side walls 16' present a rectangular or square shape cross section. The bottom wall 18' presents a corresponding rectangular or square shape having relative measurements equivalent to the embodiment discussed above. As illustrated, the liner 14' includes a plurality of sidewalls, in this instance four, corresponding to the shell sidewalls 16'. The upper rim 40' of the liner 14' is secured to the upper rim 28' of the shell 12' formed by the sidewalls 16' by an end seam 44'. In the same manner as discussed above, the liner 14' is positioned within the interior of the shell 12' and is collapsible upon application of a movement force on the bottom wall 18'.

The present invention may be employed in storing and dispensing items other than food products. The description of the present invention for storing and dispensing food products is only illustrative and is not intended to limit the scope of the present invention. Furthermore, the present invention may be embodied in other specific forms without departing from the spirit or essential attributes thereof and, accordingly, reference should be made to the appended claims, rather than to the foregoing specification, as indicating the scope of the invention.

I claim:

1. A container for storing and dispensing food products, comprising:

a housing, the housing including a base and a generally tubular enclosure extending from the base and terminating in a rim, the base and the enclosure defining an internal cavity, the rim defining an opening to the internal cavity, the base being attached to the enclosure by a breakaway seal; and a pouch positioned within the housing, the pouch including an opening to an internal pouch cavity, the pouch opening defining a pouch edge, the pouch edge being fixedly attached to the housing rim.

2. A container for storing and dispensing food products, comprising:

a housing, the housing including a base and a generally tubular enclosure extending from the base and terminating in a rim, the base and the enclosure defining an internal cavity, the rim defining an opening to the internal cavity, the base initially detachably affixed by a frangible portion to the enclosure; and a pouch positioned within the housing, the pouch including an opening to an internal pouch cavity, the pouch opening defining a pouch edge, the pouch edge being fixedly attached to the housing rim.

3. A container as recited in claim 2, wherein the base is movable into the housing internal cavity.

4. A container as recited in claim 3, wherein an exterior diameter of the base is substantially equal to an interior diameter of the enclosure such that the base is movable along the enclosure upon the application of a force normal to the base yet maintain a relative position with the enclosure when the force is not present.

5. A container as recited in claim 2, wherein the base engages the pouch upon movement into the housing internal cavity.

6. A container as recited in claim 5, wherein the pouch is constructed of a collapsible material.

7. A container as recited in claim 2, wherein the pouch is attached to the base.

8. A container as recited in claim 2, wherein the base is attached to the enclosure by a breakaway seal.

9. A container for storing and dispensing individualized goods, comprising:

a casing including a bottom wall and a sidewall extending from the bottom wall, the sidewall and the bottom wall defining an interior chamber of the casing, the bottom wall initially formed with the sidewall and affixed by a frangible connection to the sidewall yet separable therefrom for travel into the casing chamber, the sidewall including an opening opposite the bottom wall, the opening defining a casing edge; and a pouch situated within the shell chamber, the pouch including an opening to an internal pouch chamber, the pouch opening defining a pouch edge, the pouch edge fixedly fastened to the casing edge.

10. A container as set forth in claim 9, wherein the casing comprises a single sidewall, the sidewall having a generally cylindrical shape extending from the bottom wall and providing an interior diameter, the bottom wall having a generally circular shape and providing an exterior diameter substantially equal to the container sidewall interior diameter to allow the bottom wall to move along the casing sidewall into the casing interior chamber upon application of a force perpendicular to the bottom wall yet maintain a relative position with the casing sidewall when the perpendicular force is removed.

11. A container as set forth in claim 9, wherein the casing comprises a plurality of sidewalls, the plurality of sidewalls configured having a cross section parallel to the bottom wall defining a two dimensional geometric shape, the two dimensional geometric shape having an interior circumference, the bottom wall defining a two dimensional geometric shape equivalent to the geometric shape defined by the plurality of sidewalls and having an exterior circumference substantially equal to the interior circumference of the plurality of sidewalls to allow the bottom wall to move along the plurality of sidewalls into the casing interior chamber upon application of a force perpendicular to the bottom wall yet maintain a relative position with the sidewall when the perpendicular force is removed.

12. A container for storing and dispensing food products, comprising:

a shell including a bottom wall and a sidewall extending from the bottom wall, the sidewall and the bottom wall defining an interior of the shell, the bottom wall initially formed with a frangible attachment to the sidewall and being detachable from the sidewall for movement into the shell interior, the sidewall including an opening opposite the bottom wall, the opening defining a shell edge; and a liner positioned within the shell interior, the liner including a sidewall defining a liner cavity, the liner sidewall including an opening to the liner cavity, the liner opening defining a liner edge, the liner edge being fixedly attached to the shell edge.

13. A container as set forth in claim 12, wherein the shell comprises a single sidewall, the sidewall having a generally cylindrical shape extending from the bottom wall and providing an interior diameter, the bottom wall having a generally circular shape and providing an exterior diameter substantially equal to the container sidewall interior diameter to allow the bottom wall to move along the shell sidewall into the shell interior upon application of a force perpendicular to the bottom wall yet maintain a relative position with the shell sidewall when the perpendicular force is removed.

14. A container as set forth in claim 12, wherein the shell comprises a plurality of sidewalls, the plurality of sidewalls configured having a cross section parallel to the bottom wall defining a two dimensional geometric shape, the two dimensional geometric shape having an interior circumference, the bottom wall defining a two dimensional geometric shape equivalent to the geometric shape defined by the plurality of sidewalls and having an exterior circumference substantially equal to the interior circumference of the plurality of sidewalls to allow the bottom wall to move along the shell sidewall into the shell interior upon application of a force perpendicular to the bottom wall yet maintain a relative position with the sidewall when the perpendicular force is removed.

15. A container as set forth in claim 12, wherein the shell bottom wall engages the liner upon movement into the shell interior and the liner is constructed of a collapsible material.

16. A container as set forth in claim 12, wherein the shell bottom wall is initially attached to the shell sidewall by perforations.

17. A container as set forth in claim 12, wherein the liner is connected to the shell bottom wall.

18. A container for storing and dispensing food products, comprising:

a shell including a bottom wall and a sidewall extending from the bottom wall, the sidewall and the bottom wall defining an interior of the shell, the shell bottom wall being initially attached to the shell sidewall by perforations, the bottom wall detachably connected to the sidewall for movement of the bottom wall into the shell interior, the sidewall including an opening opposite the bottom wall, the opening defining a shell edge; and a liner positioned within the shell interior, the liner including a sidewall defining a liner cavity, the liner sidewall including an opening to the liner cavity, the liner opening defining a liner edge, the liner edge being fixedly attached to the shell edge.

* * * * *